US009211564B2

(12) United States Patent
Hofmann

(10) Patent No.: US 9,211,564 B2
(45) Date of Patent: Dec. 15, 2015

(54) METHODS OF FABRICATING A LAYER OF METALLIC GLASS-BASED MATERIAL USING IMMERSION AND POURING TECHNIQUES

(71) Applicant: California Institute of Technology, Pasadena, CA (US)

(72) Inventor: Douglas Hofmann, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 169 days.

(21) Appl. No.: 14/060,478

(22) Filed: Oct. 22, 2013

(65) Prior Publication Data

US 2014/0141164 A1 May 22, 2014

Related U.S. Application Data

(60) Provisional application No. 61/727,362, filed on Nov. 16, 2012.

(51) Int. Cl.

| | |
|---|---|
| ***B05D 1/18*** | (2006.01) |
| ***C23C 30/00*** | (2006.01) |
| ***C23C 2/04*** | (2006.01) |
| ***B05D 1/00*** | (2006.01) |
| ***B05D 1/02*** | (2006.01) |
| ***B05D 7/22*** | (2006.01) |
| ***C23C 2/12*** | (2006.01) |
| ***C23C 2/28*** | (2006.01) |

(Continued)

(52) U.S. Cl.

CPC *B05D 1/18* (2013.01); *B05D 1/005* (2013.01); *B05D 1/02* (2013.01); *B05D 7/222* (2013.01); *C23C 2/04* (2013.01); *C23C 2/12* (2012.01); *C23C 2/28* (2013.01); *C23C 2/38* (2013.01); *C23C 4/08* (2013.01); *C23C 4/121* (2013.01); *C23C 4/185* (2013.01); *C23C 6/00* (2013.01)

(58) Field of Classification Search

None

See application file for complete search history.

(56) References Cited

U.S. PATENT DOCUMENTS

| | | | |
|---|---|---|---|
| RE29,989 | E | 5/1979 | Polk |
| 4,173,393 | A | 11/1979 | Maurer |

(Continued)

FOREIGN PATENT DOCUMENTS

| | | | |
|---|---|---|---|
| EP | 0 183 220 | A2 * | 6/1986 |
| EP | 0 518 337 | A1 * | 12/1992 |

(Continued)

OTHER PUBLICATIONS

Fu et al., "Sliding behavior of metallic glass Part I. Experimental investigations", Wear, 2001, vol. 250, pp. 409-419.

(Continued)

*Primary Examiner* — William Phillip Fletcher, III

(74) *Attorney, Agent, or Firm* — Kilpatrick Townsend & Stockton LLP

(57) ABSTRACT

Systems and methods in accordance with embodiments of the invention implement layers of metallic glass-based materials. In one embodiment, a method of fabricating a layer of metallic glass includes: applying a coating layer of liquid phase metallic glass to an object, the coating layer being applied in a sufficient quantity such that the surface tension of the liquid phase metallic glass causes the coating layer to have a smooth surface; where the metallic glass has a critical cooling rate less than 1000 K/s; and cooling the coating layer of liquid phase metallic glass to form a layer of solid phase metallic glass.

20 Claims, 9 Drawing Sheets

(51) Int. Cl.

| | |
|---|---|
| ***C23C 2/38*** | (2006.01) |
| ***C23C 4/18*** | (2006.01) |
| ***C23C 4/08*** | (2006.01) |
| ***C23C 4/12*** | (2006.01) |
| ***C23C 6/00*** | (2006.01) |

(56) References Cited

U.S. PATENT DOCUMENTS

| | | | | |
|---|---|---|---|---|
| 4,202,404 | A | 5/1980 | Carlson | |
| 4,711,795 | A | 12/1987 | Takeuchi et al. | |
| 4,810,314 | A | 3/1989 | Henderson et al. | |
| 4,812,150 | A | 3/1989 | Scott | |
| 4,851,296 | A | 7/1989 | Tenhover et al. | |
| 5,288,344 | A | 2/1994 | Peker et al. | |
| 5,772,803 | A | 6/1998 | Peker et al. | |
| 6,771,490 | B2 | 8/2004 | Peker et al. | |
| 6,843,496 | B2 * | 1/2005 | Peker et al. | 280/610 |
| 6,887,586 | B2 | 5/2005 | Peker et al. | |
| 7,073,560 | B2 | 7/2006 | Kang et al. | |
| 7,075,209 | B2 | 7/2006 | Howell et al. | |
| 7,357,731 | B2 | 4/2008 | Johnson et al. | |
| 7,360,419 | B2 | 4/2008 | French et al. | |
| 7,500,987 | B2 | 3/2009 | Bassler et al. | |
| 7,896,982 | B2 | 3/2011 | Johnson et al. | |
| 8,400,721 | B2 | 3/2013 | Bertele et al. | |
| 2002/0100573 | A1 | 8/2002 | Inoue et al. | |
| 2003/0062811 | A1 | 4/2003 | Peker et al. | |
| 2007/0034304 | A1 | 2/2007 | Inoue et al. | |
| 2009/0114317 | A1 | 5/2009 | Collier et al. | |
| 2010/0279147 | A1 * | 11/2010 | Kusinski et al. | 428/678 |
| 2012/0073710 | A1 | 3/2012 | Kim et al. | |
| 2013/0139964 | A1 | 6/2013 | Hofmann et al. | |
| 2014/0202595 | A1 | 7/2014 | Hofmann | |
| 2014/0224050 | A1 | 8/2014 | Hofmann et al. | |
| 2014/0227125 | A1 | 8/2014 | Hofmann | |
| 2014/0246809 | A1 | 9/2014 | Hofmann | |

FOREIGN PATENT DOCUMENTS

| | | | |
|---|---|---|---|
| EP | 1063312 | A1 | 12/2000 |
| EP | 1138798 | A1 | 10/2001 |
| EP | 1404884 | B1 | 7/2007 |
| EP | 1944138 | A2 | 7/2008 |
| WO | 2014058498 | A3 | 4/2014 |

OTHER PUBLICATIONS

Kozachkov et al., "Effect of cooling rate on the volume fraction of B2 phases in a CuZrAlCo metallic glass matrix composite", Intermetallics, 2013, vol. 39, pp. 89-93.

International Search Report and Written Opinion for International Application No. PCT/US2013/050614, Search Completed May 7, 2014, Mailed May 7, 2014, 12 pgs.

"Harmonic Drive AG", website, printed from http://harmoncdrive.aero/?idcat=471, Feb. 20, 2014, 2 pgs.

"Harmonic Drive Polymer GmbH", printed Feb, 20, 2014 from http://www.harmonicdrive.de/English/the-company/subsidiaries/harmonic-drivepolymer-gmbh.html, 1 pg.

International Search Report and Written Opinion for International Application PCT/US2013/047950, completed Oct. 8, 2013, 9 pgs.

"Introduction to Thermal Spray Processing", ASM International, Handbook of Thermal Spray Technology (#06994G), 2004, 12 pgs.

Abrosimova et al., "Crystalline layer on the surface of Zr-based bulk metallic glasses", Journal of Non-Crystalline solids, 2001, vol. 288, pp. 121-126.

An et al., "Synthesis of single-component metallic glasses by thermal spray of nanodroplets on amorphous substrates", Applied Physics Letters, 2012, vol. 100, pp. 041909-1-041909-4.

Anstis et al., "A Critical Evaluation of Indentation Techniques for Measuring Fracture Toughness: I, Direct Crack Measurements", Journal of American Ceramic Society, Sep. 1981, vol. 64, No. 8, pp. 533-538.

Ashby et al., "Metallic glasses of structural materials", Scripta Materialia, 2006, vol. 54, pp. 321-326.

Bakkal, "Sliding tribological characteristics of Zr-based bulk metallic glass under lubricated conditions", Intermetallics, 2010, vol. 18, pp. 1251-1253.

Bardt et al., "Micromolding three-dimensional amorphous metal structures", J. Mater. Res, Feb. 2007, vol. 22, No. 2, pp. 339-343.

Basu et al., "Laser surface coating of Fe—Cr—Mo—Y—B—C bulk metallic glass composition on AISI 4140 steel", Surface & Coatings Technology, 2008, vol. 202, pp. 2623-2631.

Boopathy et al., "Near-threshold fatigue crack growth in bulk metallic glass composites", J. Mater. Res., vol. 24, No. 12, pp. 3611-3619.

Branagan et al., "Wear Resistant Amorphous and Nanocomposite Steel Coatings", Met. Mater. Trans. A, 2001, 32A; Idaho National Engineering and Environmental Laboratory, DOI 10.1007/s11661-001-0051-8, 15 pgs.

Cadney et al., "Cold gas dynamic spraying as a method for freeforming and joining materials", Science Direct, Surface & Coatings Technology, 202, 2008, pp. 2801-2806.

Calin et al., "Improved mechanical behavior of Cu—Ti-based bulk metallic glass by in situ formation of nanoscale precipitates", Scripta Materialia, 2003, vol. 48, pp. 653-658.

Chen et al., "Elastic Constants, Hardness and Their Implications to Flow Properties of Metallic Glasses", Journal of Non-Crystalline Solids, 1975, vol. 18, pp. 157-171.

Chen et al., "Formation of Micro-Scale Precision Flexures Via Molding of Metallic Glass", Source and date unknown, 4 pgs.

Chen et al., "Influence of laser surface melting on glass formation and tribological behaviors of $Zr_{55}Al_{10}Ni_5Cu_{30}$ alloy", J. Mater Res. Oct. 28, 2011, vol. 26, No. 20, pp. 2642-2652.

Cheng, "Characterization of mechanical properties of FeCrBSiMnNbY metallic glass coatings", J Mater Sci., 2009, vol. 44, pp. 3356-3363.

Choi et al., "Tribological behavior of the kinetic sprayed $Ni_{59}Ti_{16}Zr_{20}Si_2Sn_3$", Journal of Alloys and Compounds, 2007, vol. 434-435, pp. 64-67.

Conner et al., "Shear band spacing under bending of Zr-based metallic glass plates", Acta Materialia, 2004, vol. 52, pp. 2429-2434.

Conner et al., "Shear bands and cracking of metallic glass plates in bending", Journal of Applied Physics, Jul. 15, 2003, vol. 94, No. 2, pp. 904-911.

Dai et al., "A new centimeter-diameter Cu-based bulk metallic glass", Scripta Materialia, 2006, vol. 54, pp. 1403-1408.

Davis, "Hardness/Strength Ratio of Metallic Glasses", Scripta Metallurgica, 1975, vol. 9, pp. 431-436.

De Beer et al., "Surface Folds Make Tears and Chips", Physics, 2012, vol. 100, 3 pgs.

Dislich et al., "Amorphous and Crystalline Dip Coatings Obtained from Organometallic Solutions: Procedures, Chemical Processes and Products", Metallurgical and Protective Coatings, 1981, vol. 77, pp. 129-139.

Duan et al., "Lightweight Ti-based bulk metallic glasses excluding late transition metals", Scripta Materialia, 2008, vol. 58, pp. 465-468.

Duan et al., "Tribological properties of $Zr_{41.25}Ti_{13.75}Ni_{10}Cu_{12.5}Be_{22.5}$ bulk metallic glasses under different conditions", Journal of Alloys and Compounds, 2012, 528, pp. 74-78.

Fleury et al., "Tribological properties of bulk metallic glasses", Materials Science and Engineering, 2004, vol. A375-377, pp. 276-279.

Fornell et al., "Enhanced mechanical properties and in vitro corrosion behavior of amorphous and devitrified T140Zr10Cu38Pd12 metallic glass", Journal of the Mechanical Behavior of Biomedical Materials, 2011, vol. 4, pp. 1709-1717.

Ganesan et al. "Bonding behavior studies of cold sprayed copper coating on the PVC polymer substrate", Surface & Coatings Technology, 2012, vol. 207, pp. 262-269.

Garrett et al., "Effect of microalloying on the toughness of metallic glasses", Applied Physics Letter, 2012, vol. 101, 241913-1-241913-3.

Gleason Corporation, "Gear Product News", Introducing genesis, The Next Generation in Gear Technology, Apr. 2006, 52 pgs.

Gloriant, "Microhardness and abrasive wear resistance of metallic glasses and nanostructured composite materials", Journal of Non-Crystalline Solids, 2003, vol. 316, pp. 96-103.

(56) References Cited

OTHER PUBLICATIONS

Greer, "Partially or fully devitrified alloys for mechanical properties", Materials and Science and Engineering, 2001, vol. A304, pp. 68-72.
Greer et al., "Wear resistance of amorphous alloys and related materials", International Materials Reviews, 200, vol. 47, No. 2, pp. 87-112.
Hale, "Principles and Techniques for Designing Precision Machines", Ph.D. Thesis, Feb. 1999, 493 pgs.
Haruyama et al., "Volume and enthalpy relaxation in $Zr_{55}Cu_{30}Ni_5Al_{10}$ bulk metallic glass", Acta Materialia, 2010, vol. 59, pp. 1829-1836.
Hejwowski et al., "A comparative study of electrochemical properties of metallic glasses and weld overlay coatings", Vacuum 88 (2013) 118-123.
Hofmann, "Bulk Metallic Glasses and Their Composites: A Brief History of Diverging Fields", Journal of Materials, 2013, vol. 2013, 7 pgs.
Hofmann, "Shape Memory Bulk Metallic Glass Composites", Science, Sep. 10, 2010, vol. 329, pp. 1294-1295.
Hofmann et al., "Designing metallic glass matrix composites with high toughness and tensile ductility", Nature Letters, Feb. 28, 2008, vol. 451, pp. 1085-1090.
Hofmann et al., "Semi-solid Induction Forging of Metallic Glass Matrix Composites", JOM, Dec. 2009, vol. 61, No. 12, pp. 11-17, plus cover.
Hong et al., "Dry sliding tribological behavior of Zr-based bulk metallic glass", Trans. Nonferrous Met. Soc. China, 2012, vol. 22, pp. 585-589.
Hong et al., "Microstructurel characteristics of high-velocity oxygen-fuel (HVOF) sprayed nickel-based alloy coating", Journal of Alloys and Compounds 581 (2013) pp. 398-403.
Huang et al., "Fretting wear behavior of bulk amorphous steel", Intermetallics, 2011, vol. 19, pp. 1385-1389.
Inoue et al., "Cobalt-based bulk glassy alloy with ultrahigh strength and soft magnetic properties", Nature Materials, Oct. 2003, vol. 2, pp. 661-663.
Inoue et al., "Preparation of 16 mm diameter Rod of Amorphous $Zr_{65}Al_{7.5}Ni_{10}Cu_{17.5}$ Alloy", Material Transactions, Jim, 1993, vol. 34, No. 12, pp. 1234-1237.
Ishida et al., "Wear resistivity of super-precision microgear made of Ni-based metallic glass", Materials Science and Engineering, 2007, vol. A449-451, pp. 149-154.
Jiang et al, "Progress in low density bulk metallic glasses and their composites", pp. 1-56.
Jiang et al., "Tribological Studies of a Zr-Based Glass-Forming Alloy with Different States", Advanced Engineering Materials, 2009, vol. 1, No. 11, pp. 925-931.
Kahraman et al., "A Feasibility Study on Development of Dust Abrasion Resistant Gear Concepts for Lunar Vehicle Gearboxes", NASA Grant NNX07AN42G Final Report, Mar. 11, 2009, 77 pgs.
Kim, "Amorphous phase formation of Zr-based alloy coating by HVOF spraying process", Journal of Materials Science 36 (2001) pp. 49-54.
Kim et al. "Enhancement of metallic glass properties of Cu-based BMG coating by shroud plasma spraying", Science Direct, Surface & Coatings Technology 205 (2011) pp. 3020-3026.
Kim et al. "Oxidation and crystallization mechanisms in plasma-sprayed Cu-based bulk metallic glass coatings", Acta Materialia, 2010, vol. 58, pp. 952-962.
Kim et al., "Production of $Ni_{65}Cr_{15}P_{16}B_4$ Metallic Glass-Coated Bipolar Plate for Fuel Cell by High Velocity Oxy-Fuel (HVOF) Spray Coating Method", The Japan Institute of Metals, Materials Transactions, vol. 51, No. 9 (2010) pp. 1609-1613.
Kobayashi et al. "Property of Ni-Based Metallic Glass Coating Produced by Gas Tunnel Type Plasma Spraying", International Plasma Chemistry Society, ISPC 20, 234, Philadelphia, USA; Retrieved from: http://www.ispc-conference.org/ispcproc/ispc20/234.pdf.
Kobayashi et al., "Fe-based metallic glass coatings produced by smart plasma spraying process", Materials Science and Engineering, 2008, vol. B148, pp. 110-113.
Kobayashi et al., "Mechanical property of Fe-base metallic glass coating formed by gas tunnel type plasma spraying", ScienceDirect, Surface & Coatings Technology (2007), 6 pgs.
Kong et al., "Effect of Flash Temperature on Tribological Properties of Bulk Metallic Glasses", Tribol. Lett., 2009, vol. 35, pp. 151-158.
Kumar et al., "Bulk Metallic Glass: The Smaller the Better", Advanced Materials, 2001, vol. 23, pp. 461-476.
Kwon et al., "Wear behavior of Fe-based bulk metallic glass composites", Journal of Alloys and Compounds, 2011, vol. 509S, pp. S105-S108.
Launey et al., "Solution to the problem of the poor cyclic fatigue resistance of bulk metallic glasses", PNAS Early Edition, pp. 1-6.
Li et al., "Wear behavior of bulk $Zr_{41}Ti_{14}Cu_{12.5}Ni_{10}Be_{22.5}$ metallic glasses", J. Mater. Res., Aug. 2002, vol. 17, No. 8, pp. 1877-1880.
Lillo et al. "Microstructure, Processing, Performance Relationships for High Temperature Coatings", U.S. Department of Energy, Office of Fossil Energy, under DOE Idaho Operations Office, Contract DE-AC07-05ID14517; 22nd Annual Conference on Fossil Energy Materials, Pittsburgh, U.S., 8 pgs.
List et al., "Impact Conditions for Cold Spraying of Hard Metallic Glasses", Journal of Thermal Spray Technology, Jun. 2012, vol. 21, No. 3-4, pp. 531-540.
Liu, "Microstructure and properties of Fe-based amorphous metallic coating produced by high velocity axial plasma spraying", Science Direct, Journal of Alloys and Compounds 484 (2009) pp. 300-307.
Liu et al., "Influence of Heat Treatment on Microstructure and Sliding Wear of Thermally Sprayed Fe-Based Metallic Glass coatings", Tribol. Lett., 2012, vol. 46, pp. 131-138.
Liu et al., "Metallic glass coating on metals plate by adjusted explosive welding technique", Applied Surface Science, 2009, vol. 255, pp. 9343-9347.
Liu et al., "Sliding Tribological Characteristics of a Zr-based Bulk Metallic Glass Near the Glass Transition Temperature", Tribol. Lett. 2009, vol. 33, pp. 205-210.
Liu et al., "Wear behavior of a Zr-based bulk metallic glass and its composites", Journal of Alloys and Compounds, 2010, vol. 503, pp. 138-144.
Lupoi et al. "Deposition of metallic coatings on polymer surfaces using cold spray", Science Direct, Surface & Coatings Technology 205 (2010) pp. 2167-2173.
Ma et al., "Wear resistance of Zr-based bulk metallic glass applied in bearing rollers", Materials Science and Engineering, 2004, vol. A386, pp. 326-330.
Maddala et al., "Effect of notch toughness and hardness on sliding wear of $Cu_{50}Hf_{41.5}A_{18.5}$ bulk metallic glass", Scripta Materialia, 2011, vol. 65, pp. 630-633.
Ni, "High performance amorphous steel coating prepared by HVOF thermal spraying", Journal of Alloys and Compounds 467 (2009) pp. 163-167.
Parlar et al., "Sliding tribological characteristics of Zr-based bulk metallic glass", Intermetallics, 2008, vol. 16, pp. 34-41.
Pauly et al., "Modeling deformation behavior of Cu-Zr-Al bulk metallic glass matrix composites", Applied Physics Letters, 2009, vol. 95, pp. 101906-1-101906-3.
Ponnambalam et al., "Fe-based bulk metallic glasses with diameter thickness larger than one centimeter", J Mater Res, 2004, vol. 19; pp. 1320-1323.
Porter et al., "Incorporation of Amorphous Metals into MEMS for High Performance and Reliability", Rockwell Scientific Company, Final Report, Nov. 2003, 41 pgs.
Prakash et al., "Sliding wear behavior of some Fe-, Co-and Ni-based metallic glasses during rubbing against bearing steel", Tribology Letters, 2000, vol. 8, pp. 153-160.
Ramamurty et al., "Hardness and plastic deformation in a bulk metallic glass", Acta Materialia, 2005, vol. 53, pp. 705-717.
Revesz et al. "Microstructure and morphology of Cu—Zr—Ti coatings produced by thermal spray and treated by surface mechanical attrition", ScienceDirect, Journal of Alloys and Compounds 509S (2011) S482-S485.

(56) References Cited

OTHER PUBLICATIONS

Rigney et al., "The Evolution of Tribomaterial During Sliding: A Brief Introduction", Tribol. Lett, 2010, vol. 39, pp. 3-7.
Roberts et al., "Cryogenic Charpy impact testing of metallic glass matrix composites", Scripta Materialia, 2011, 4 pgs.
Schuh et al., "A survey of instrumented indentation studies on metallic glasses", J. Mater. Res., Jan. 2004, vol. 19, No. 1, pp. 46-57.
Segu et al., "Dry Sliding Tribological Properties of Fe-Based Bulk Metallic Glass", Tribol. Lett., 2012, vol. 47, pp. 131-138.
Shen et al., "Exceptionally high glass-forming ability of an FeCoCrMoCBY alloy", Applied Physics, 2005, vol. 86, pp. 151907-1-151907-3.
Sundaram et al., "Mesoscale Folding, Instability, and Disruption of Laminar Flow in Metal Surfaces", Physical Review Letters, Sep. 7, 2012, vol. 109, pp. 106001-1-106001-5.
Tam et al., "Abrasion resistance of Cu based bulk metallic glasses", Journal of Non-Crystalline Solids, 2004, vol. 347, pp. 268-272.
Tam et al., "Abrasive wear of $Cu_{60}Zr_{30}Ti_{10}$ bulk metallic glass", Materials Science and Engineering, 2004, vol. A384 pp. 138-142.
Tao et al., "Effect of rotational sliding velocity on surface friction and wear behavior in Zr-based bulk metallic glass", Journal of Alloys and Compounds, 2010, vol. 492, pp. L36-L39.
Tao et al., "Influence of isothermal annealing on the micro-hardness and friction property in CuZrAl bulk metallic glass", Advanced Materials Research, 2011, vols. 146-147, pp. 615-618.
Tobler et al., "Cryogenic Tensile, Fatigue, and Fracture Parameters for a Solution-Annealed 18 Percent Nickel Maraging Steel", Journal of Engineering Materials and Technology, Apr. 1978, vol. 100, pp. 189-194.
Wagner, "Mechanical Behavior of 18 Ni 200 Grade Maraging Steel at Cyrogenic Temperatures", J Aircraft, Oct. 1986, vol. 23, No. 10, pp. 744-749.
Wang et al., "Progress in studying the fatigue behavior of Zr-based bulk-metallic glasses and their composites", Intermetallics, 2009, vol. 17, pp. 579-590.
Wikipedia, "Harmonic Drive", printed Feb. 20, 2014, 4 pgs.
Wu et al., "Bulk Metallic Glass Composites with Transformation-Mediated Work-Hardening and Ductility", Adv. Mater., 2010, vol. 22, pp. 2770-2773.
Wu et al., "Effects of environment on the sliding tribological behaviors of Zr-based bulk metallic glass", Intermetallics, 2012, vol. 25, 115-125.
Yin et al. "Microstructure and mechanical properties of a spray-formed Ti-based metallic glass former alloy", ScienceDirect, Journal of Alloys and Compounds 512 (2012) 241-245.
Zachrisson et al., "Effect of Processing on Charpy impact toughness of metallic glass matrix composites", J. Mater. Res., May 28, 2011, vol. 26, No. 10, pp. 1260-1268.
Zhang et al. "Robust hydrophobic Fe-based amorphous coating by thermal spraying", Applied Physics Letters 101, 2012, pp. 1216031-121603-4.
Zhang et al., "Abrasive and corrosive behaviors of Cu—Zr—Al—Ag—Nb bulk metallic glasses", Journal of Physics: Conference Series, 2009, vol. 144, pp. 1-4.
Zhang et al., "Wear behavior of a series of Zr-based bulk metallic glasses", Materials Science and Engineering, 2008, vol. A475, pp. 124-127.
Zhou et al., "Microstructure and Electrochemical Behavior of Fe-Based Amorphous Metallic Coatings Fabricated by Atmospheric Plasma Spraying", Journal of Thermal Spray Technology, Jan. 2011, vol. 20, No. 1-2, pp. 344-350.
Zhuo, "Spray formed Al-based amorphous matrix nanocomposite plate", ScienceDirect, Journal of Alloys and Compounds 509 (2011) L169-L173.

* cited by examiner

METHODS OF FABRICATING A LAYER OF METALLIC GLASS-BASED MATERIAL USING IMMERSION AND POURING TECHNIQUES

CROSS-REFERENCE TO RELATED APPLICATIONS

The current application claims priority to U.S. Provisional Application No. 61/727,362, filed Nov. 16, 2012, the disclosure of which is incorporated herein by reference.

STATEMENT OF FEDERAL FUNDING

The invention described herein was made in the performance of work under a NASA contract, and is subject to the provisions of Public Law 96-517 (35 U.S.C. 202) in which the Contractor has elected to retain title.

FIELD OF THE INVENTION

The present invention generally regards layers of metallic glass-based materials, and techniques for fabricating such layers.

BACKGROUND

Metallic glasses, also known as amorphous metals, have generated much interest for their potential as robust engineering materials. Metallic glasses are characterized by their disordered atomic-scale structure in spite of their metallic constituent elements—i.e. whereas conventional metallic materials typically possess a highly ordered atomic structure, metallic glasses are characterized by their disordered atomic structure. Notably, metallic glasses typically possess a number of useful material properties that can allow them to be implemented as highly effective engineering materials. For example, metallic glasses are generally much harder than conventional metals, and are generally tougher than ceramic materials. They are also relatively corrosion resistant, and, unlike conventional glass, they can have good electrical conductivity.

Nonetheless, the manufacture and implementation of metallic glasses present challenges that limit their viability as engineering materials. In particular, metallic glasses are typically formed by raising a metallic glass above its melting temperature, and rapidly cooling the melt to solidify it in a way such that its crystallization is avoided, thereby forming the metallic glass. The first metallic glasses required extraordinary cooling rates, e.g. on the order of $10^6$ K/s, to avoid crystallization, and were thereby limited in the thickness with which they could be formed because thicker parts could not be cooled as quickly. Indeed, because of this limitation in thickness, metallic glasses were initially largely limited to applications that involved coatings. Since then, however, metallic glass compositions that have lower critical cooling rates have been developed that have enabled a broader implementation of metallic glass materials. Nonetheless, implementing metallic glass coatings remains a viable technique for harnessing the advantages that metallic glasses can offer. Accordingly, the present state of the art can benefit from improved techniques for implementing layers of metallic glass.

SUMMARY OF THE INVENTION

Systems and methods in accordance with embodiments of the invention implement layers of metallic glass-based materials. In one embodiment, a method of fabricating a layer of a metallic glass includes: applying a coating layer of liquid phase metallic glass to an object, the coating layer being applied in a sufficient quantity such that the surface tension of the liquid phase metallic glass causes the coating layer to have a smooth surface; where the metallic glass has a critical cooling rate less than 1000 K/s; and cooling the coating layer of liquid phase metallic glass to form a layer of solid phase metallic glass.

In another embodiment, the thickness of the coating layer is greater than 50 micrometers.

In yet another embodiment, the thickness of the coating layer is greater than 1 mm.

In still another embodiment, the thickness of the coating layer is thinner than the plastic zone size of the metallic glass.

In still yet another embodiment, the object includes one of aluminum, titanium, steel, cobalt, graphite, quartz, silicon carbide, and mixtures thereof.

In a further embodiment, the metallic glass is a composition that has a glass forming ability such that it can be readily cast in to parts having a thickness greater than approximately 1 mm.

In a yet further embodiment, the metallic glass is a composition that has a glass forming ability such that it can be readily cast in to parts having a thickness greater than approximately 3 mm.

In a still yet further embodiment, the metallic glass is one of: Cu40Zr40Al7Be10Nb3, Cu45Zr45Al5Y2Nb3, Cu42.5Zr42.5Al7Be5Nb3, Cu41.5Zr41.5Al7Be7Nb3, Cu41.5Zr41.5Al7Be7Cr3, Cu44Zr44Al5Ni3Be4, Cu46.5Zr46.5Al7, Cu43Zr43Al7Ag7, Cu41.5Zr41.5Al7Be10, Cu44Zr44Al7Be5, Cu43Zr43Al7Be7, Cu44Zr44Al7Ni5, Cu40Zr40Al10Be10, Cu41Zr40Al7Be7Co5, Cu42Zr41Al7Be7Co3, Cu47.5Zr48Al4Co0.5, Cu47Zr46Al5Y2, Cu50Zr50, Ti33.18Zr30.51Ni5.33Be22.88Cu8.1, Ti40Zr25Be30Cr5, Ti40Zr25Ni8Cu9Be18, Ti45Zr16Ni9Cu10Be20, Zr41.2Ti13.8Cu12.5Ni10Be22.5, Zr52.5Ti5Cu17.9Ni14.6Al10, Zr58.5Nb2.5Cu15.6Ni12.8Al10.3, Zr55Cu30Al10Ni5, Zr65Cu17.5Al7.5Ni10, ZrAlCo, Zr36.6Ti31.4Nb7Cu5.9Be19.1, Zr35Ti30Cu8.25Be26.75, and mixtures thereof.

In another embodiment, cooling the coating layer includes subjecting the liquid phase metallic glass to cooling gases.

In yet another embodiment, cooling the coating layer includes allowing the coating layer to cool via thermal conduction.

In still another embodiment, the method of fabricating a layer of metallic glass further includes spinning the coating layer of liquid phase metallic glass to eliminate excess liquid phase metallic glass.

In still yet another embodiment, the object has a lower melting temperature than the metallic glass, and where the cooling is done with such rapidity that thermal energy from the coating layer does not have time to diffuse from the coating layer to the object to thereby melt it.

In a further embodiment, the object is the interior of a pipe.

In a yet further embodiment, the application of a coating of liquid phase metallic glass to an object and the cooling of the coating layer of liquid phase metallic glass occur in an inert environment to discourage contamination of the layer of metallic glass.

In a still further embodiment, the inert environment is effectuated by substantially immersing the object in one of argon, helium, neon, nitrogen, and mixtures thereof.

In a still yet further embodiment, the application of a coating layer of liquid phase metallic glass to an object includes one of: immersing at least a portion of the object in a bath of the liquid phase metallic glass; and pouring the liquid phase metallic glass over at least a portion of the object.

In another embodiment, the object is one of: a laptop case, an electronic case, a mirror, sheet metal, a metal foam, a graphite parts, a part made from refractory metals, an aluminum part, a pyrolyzed polymer part, a titanium part, a steel part, a knife, a gear, a golf club, a baseball bat, a watch, jewelry, a metal tool, and a biomedical implant.

In still another embodiment, a forming tool is used to form the coated layer of liquid phase metallic glass.

In yet another embodiment, the forming tool is a rolling wheel.

In a further embodiment, the method of fabricating a layer of metallic glass further includes separating the layer of solid phase metallic glass from the object.

DETAILED DESCRIPTION

Figure 1:
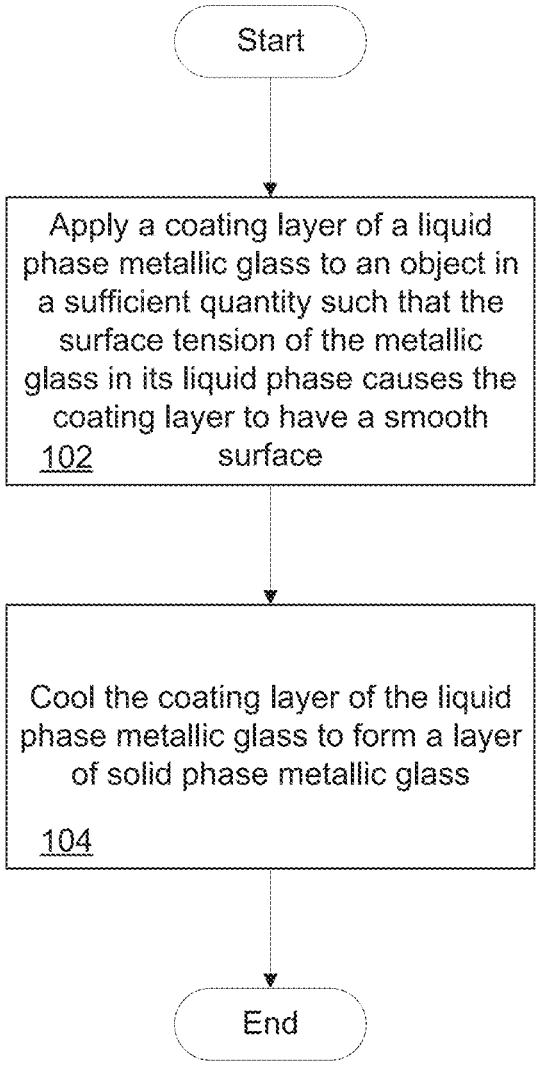
FIG. 1 illustrates a process for forming a layer of metallic glass in accordance with embodiments of the invention.

Turning now to the drawings, systems and methods for implementing layers of metallic glass-based materials are illustrated. For the purposes of this patent application, the term 'metallic glass' shall be interpreted to be inclusive of 'metallic glass composites', except where otherwise noted. Metallic glass composites are characterized in that they possess the amorphous structure of metallic glasses, but they also include crystalline phases of material within the matrix of the amorphous structure. Crystalline phases can allow a material to have enhanced ductility, compared to where the material is entirely constituted of the amorphous structure. Many techniques can be used to implement layers of metallic glass, e.g. metallic glass coatings on objects. However, many of the techniques that have been used thus far exhibit a number of shortcomings. For example, thermal spraying techniques have been used to implement metallic glass coatings. Thermal spraying techniques generally regard spraying heated material onto an object to establish a coating. In some thermal spraying techniques, metallic glass in a powdered form of micrometer sized particles is sprayed onto the object to be coated. In other thermal spraying techniques, metallic glass in a wire form is heated to a molten state and thereby applied to the object to be coated. However, these thermal spraying techniques are limited insofar as they usually result in a coating that has a very rough surface finish; in many instances it is desirable for the coating to have a smooth finish. Moreover, thermal spraying techniques generally can be fairly time-consuming. Additionally, these techniques may be fairly expensive to implement because the feedstock, e.g. the metallic glass in powdered form, can be costly.

Sputtering techniques and chemical vapor deposition techniques have also been used to implement metallic glass coatings; but these techniques can have their own shortcomings. For example, sputtering techniques and chemical vapor deposition techniques generally regard a layer by layer deposition of material on an atomic scale. With this being the case, such processes can be extremely slow. Moreover, the thickness of the coating layer can be substantially limited, in many cases less than 10 micrometers.

Notably, in the context of implementing metallic glass layers, these techniques have been applied with an extensive focus on ensuring a fast cooling rate to facilitate the formation of the solid phase metallic glass. However, metallic glass alloy compositions have now been developed that have critical cooling rates sufficiently low such that parts having thicknesses on the order of millimeters can readily be developed, e.g. by casting processes. These metallic alloy compositions are generally known as 'bulk metallic glasses' (BMGs). Such materials that have an amorphous structure but also include crystalline phases within the amorphous matrix are known as 'bulk metallic glass matrix composites' (BMGMCs).

Accordingly, the inventor of the instant application has observed that the development of metallic glasses having lower critical cooling rates, and thereby greater glass forming ability, can enable the development of more robust and advantageous techniques for developing layers of metallic glass. Thus, in many embodiments of the invention, a liquid phase metallic glass—the metallic glass having a relatively low critical cooling rate—is applied to an object in relatively substantial volumes, and the liquid phase metallic glass is thereafter allowed to cool to form the layer of solid phase metallic glass. The layer of solid phase metallic glass can form in spite of the fact that a relatively substantial volume of liquid phase metallic glass is used to coat the object, because the metallic glass has a relatively low critical cooling rate.

Processes for fabricating metallic glass layers are now discussed in greater detail below.

Fabricating Metallic Glass Layers

In many embodiments of the invention, liquid phase metallic glass is applied to an object in relatively substantial volumes, and is thereafter allowed to cool to form a solid phase metallic glass layer. In many embodiments, the metallic glass has a relatively low critical cooling rate, and the liquid phase metallic glass is cooled at a rate that can allow a solid phase metallic glass layer to form. In some embodiments, the quantity of liquid phase metallic glass that is applied is such that the surface tension of the liquid phase metallic glass causes the coating layer to have a smooth surface. In many embodiments, the quantity of liquid phase metallic glass that is applied is such that the thickness of the coating layer is greater than approximately 50 micrometers.

A process for implementing a layer of metallic glass where a liquid phase metallic glass is applied in a sufficient quantity such that the surface tension of the metallic glass in its liquid phase causes the coating layer to have a smooth surface in accordance with embodiments of the invention is illustrated in FIG. 1. In particular, a coating layer of liquid phase metallic glass is applied (102) to an object in a sufficient quantity such that the surface tension of the metallic glass in its liquid phases causes the coating layer to have a smooth surface across the layer. The surface tension of a liquid refers to its contractive tendency; it is generally caused by the cohesion of similar molecules, and is responsible for many of the behaviors of liquids. Thus, when a sufficient quantity of liquid phase metallic glass is applied, cohesive interactions between the constituent elements can cause an even distribution of the coating layer across the surface of the layer, i.e. the coating layer can have a smooth surface. By contrast, when thermal spraying techniques are used to implement layers of metallic glass, the metallic glass is typically sparsely distributed on to the object to be coated such that surface tension effects do not take place across the coating layer; as a consequence, thermal spraying techniques generally result in rough surface finishes.

Of course, it should be noted that although FIG. 1 illustrates applying a sufficient quantity of liquid phase metallic glass such that the surface tension of the liquid causes the coating layer to have a smooth surface, any suitable measure may be used to ensure the application of a relatively substantial volume of liquid phase metallic glass in accordance with embodiments of the invention. For instance, in some embodiments, a sufficient quantity of liquid phase metallic glass is applied such that a coating layer having a thickness of greater than approximately 50 micrometers develops. For example, in many embodiments liquid phase metallic glass is applied to develop a coating layer having a thickness as high as 1 mm or more. Of course, although a particular threshold quantity is mentioned, it should be understood that any suitable threshold value can be implemented in accordance with embodiments of the invention.

Note that this technique can further take advantage of the fact that certain metallic glass alloys, especially bulk metallic glasses, have excellent wetting characteristics. For example, many bulk metallic glasses have excellent wetting characteristics with respect to aluminum, titanium, steel, cobalt, graphite, quartz and silicon-carbide. Accordingly, in many embodiments of the invention, the object that is the subject of the application of the liquid phase metallic glass includes one of: aluminum, titanium, steel, cobalt, graphite, quartz, silicon-carbide, and mixtures thereof.

In many embodiments, the metallic glass has a relatively low critical cooling rate. A 'critical cooling rate' refers to how fast a liquid phase metallic glass must be cooled in order to form the corresponding solid phase metallic glass, i.e., in an amorphous crystalline structure. The critical cooling rate of a metallic glass is associated with its 'glass forming ability,' a term that references a measure as to how easy it is to form a solid phase metallic glass. It is desirable to use a metallic glass having a low critical cooling rate in conjunction with embodiments of the invention because relatively substantial volumes of liquid phase metallic glass are used to coat the object in many embodiments, e.g. a sufficient quantity such that a smooth coating layer surface can result. Thus, with these substantial volumes, it can become difficult to ensure a sufficiently high cooling rate such that a solid phase metallic glass can result using conventional cooling processes. However, by using a metallic glass composition that has a relatively low critical cooling rate, a solid phase metallic glass layer can form in spite of the volume of the liquid phase metallic glass applied. In many embodiments, the critical cooling rate of the metallic glass alloy is less than approximately 1000 K/s. Of course although a particular threshold value is referenced, any suitable metallic glass can be implemented in accordance with embodiments of the invention.

Additionally, although the critical cooling rate can be used as a measure of glass forming ability in accordance with embodiments of the invention, any suitable measure of glass forming ability can be used. For instance, the thickness of a part that can be readily formed from a metallic glass using standard casting procedures can be used to judge the metallic glass's glass forming ability. Accordingly, in many embodiments, a metallic glass is used that can readily be cast in to parts having a thickness of greater than approximately 1 mm. Again, although a particular threshold value is referenced, any suitable metallic glass can be implemented in accordance with embodiments of the invention. For example, in some embodiments a metallic glass is used that can be readily cast in to parts that have a thickness greater than approximately 3 mm.

Suitable metallic glasses include copper-zirconium based metallic glasses, titanium-based metallic glasses, iron-based metallic glasses, nickel-based metallic glasses, and zirconium based metallic glasses. In many embodiments, the metallic glass is one of: $Cu_{40}Zr_{40}Al_7Be_{10}Nb_3$, $Cu_{45}Zr_{45}Al_5Y_2Nb_3$, Cu42.5Zr42.5Al7Be5Nb3, $Cu_{41.5}Zr_{41.5}Al_7Be_7Nb_3$, $Cu_{41.5}Zr_{41.5}Al_7Be_7Cr_3$, $Cu_{44}Zr_{44}Al_5Ni_3Be_4$, $Cu_{46.5}Zr_{46.5}Al_{73}$, $Cu_{43}Zr_{43}Al_7Ag_7$, $Cu_{41.5}Zr_{41.5}Al_7Be_{10}$, $Cu_{44}Zr_{44}Al_7Be_5$, $Cu_{43}Zr_{43}Al_7Be_7$, $Cu_{44}Zr_{44}Al_7Ni_5$, $Cu_{40}Zr_{40}Al_{10}Be_{10}$, $Cu_{41}Zr_{40}Al_7Be_7Co_3$, $Cu_{42}Zr_{41}Al_7Be_7Co_3$, $Cu_{47.5}Zr_{48}Al_4Co_{0.5}$, $Cu_{47}Zr_{46}Al_5Y_2$, $Cu_{50}Zr_{50}$, $Ti_{33.18}Zr_{30.51}Ni_{5.33}Be_{22.88}Cu_{8.1}$, $Ti_{40}Zr_{25}Be_{30}Cr_5$, $Ti_{40}Zr_{25}Ni_8Cu_9Be_{18}$, $Ti_{45}Zr_{16}Ni_9Cu_{10}Be_{20}$, $Zr_{41.2}Ti_{13.8}Cu_{12.5}Ni_{10}Be_{22.5}$, $Zr_{52.5}Ti_5Cu_{7.9}Ni_{14.6}Al_{10}$, $Zr_{58.5}Nb_{2.5}Cu_{15.6}Ni_{12.8}Al_{10.3}$, $Zr_{55}Cu_{30}Al_{10}Ni_5$, $Zr_{65}Cu_{17.5}Al_{7.5}Ni_{10}$, ZrAlCo, $Zr_{36.6}Ti_{31.4}Nb_7Cu_{5.9}Be_{19.1}$, $Zr_{35}Ti_{30}Cu_{8.25}Be_{26.75}$, and mixtures thereof. These alloys have demonstrated sufficient glass forming ability. Of course, although several metallic glass alloys are listed, embodiments in accordance with the instant invention are not limited to using these alloys. Indeed, any suitable metallic glass can be used in accordance with embodiments of the invention.

The layer of liquid phase metallic glass is then cooled (104) to form the solid phase metallic glass layer. This generally requires a cooling rate faster than the critical cooling rate. Any suitable technique can be used to cool the layer of liquid phase metallic glass. For example, the metallic glass layer can be spun to facilitate cooling by convection. Spinning the liquid phase metallic glass has the additional advantage of getting rid of excess liquid, which can inhibit the quality of the surface finish. Indeed, in many embodiments, the layer of liquid phase metallic glass is spun primarily to get rid of excess liquid; separate cooling mechanisms can then be relied on to facilitate the cooling of the layer. Cooling gases may also be used to cool the liquid phase metallic glass. In some embodiments, the cooling of the liquid phase metallic glass layer occurs largely by thermal conduction, e.g. through object that was coated. Of course, although certain techniques for cooling the liquid phase cooling layer are mentioned, it should of course be understood that any suitable technique(s) for cooling the liquid phase metallic glass layer can be implemented in accordance with embodiments of the invention.

In many embodiments, the application of the liquid phase metallic glass and its cooling is done with such rapidity, that even where the object that is coated with liquid phase metallic glass has a lower melting point than the metallic glass, a metallic glass layer can still be developed on the object, i.e. the liquid phase metallic glass does not melt the object. In particular, liquid phase metallic glass can be applied to the object in relatively substantial volumes and cooled all prior to the thermal energy diffusing through the coated object to melt it.

Importantly, the formation of layers of metallic glass can be highly sensitive to the development of oxide layers or other contamination that can adversely impact the final material properties. In particular, many of the above listed CuZr-based alloys, Ti-based alloys, and Zr-based alloys are sensitive in this manner. Thus, in many embodiments, the application of liquid phase metallic glass and its cooling occurs in an inert environment. For instance, the application of the liquid layer and its cooling can occur in a chamber that is substantially filled with one of: argon, helium, neon, nitrogen and/or mixtures thereof (argon, helium, neon, and nitrogen being relatively inert elements).

The ability to develop metallic glass layers using relatively substantial volumes of liquid phase metallic glass can offer many advantages. For example, using relatively substantial volumes of liquid phase metallic glass can allow thicker layers of metallic glass to form, which can provide for greater structural integrity. Indeed, where a part is coated in a metallic glass layer, if the metallic glass layer is sufficiently thick, the part with the coated layer can perform in many ways as if it were entirely constituted from the metallic glass.

Figure 2A:
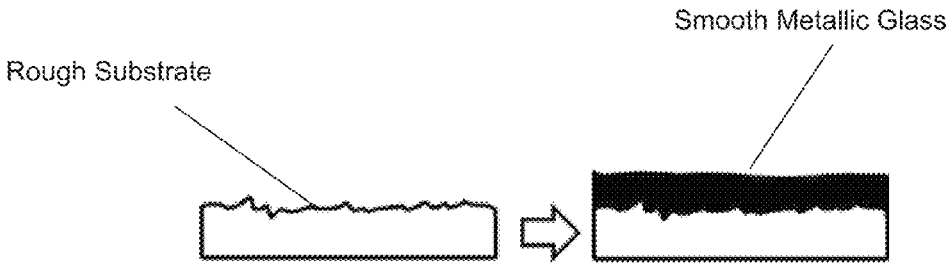
FIGS. 2A and 2B illustrate how a coating layer of metallic glass can be developed to mask a rough object surface in accordance with embodiments of the invention.
Figure 2B:
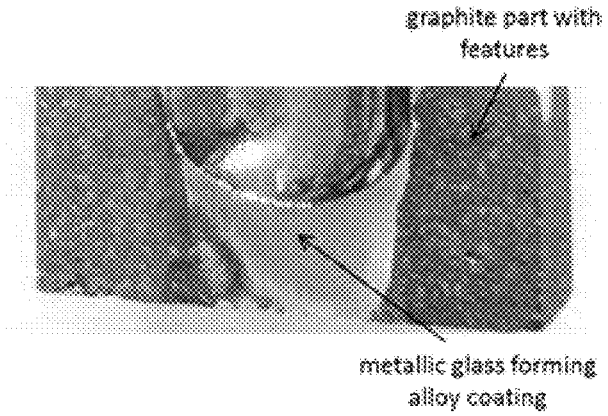

Additionally, as can be inferred from above, using relatively substantial volumes of liquid phase metallic glass can allow for the final layer of metallic glass to have a smooth finish, which in many instances can be desirable. For example, smooth finishes generally provide for appealing aesthetics. Moreover, smooth surface finishes can also be used to facilitate laminar flow, e.g. where the inside of a pipe that is to facilitate the transportation of liquid has a smooth finish. Furthermore, the smooth layer of metallic glass can be used to mask the rough surface of the object that was coated. FIGS. 2A and 2B illustrate this principle. In particular, FIG. 2A depicts a diagram showing a substrate with a rough surface finish, which is then coated by metallic glass, to develop a smooth surface finish in accordance with embodiments of the invention. In effect, the liquid phase metallic glass, when applied, can fill into any pores or openings that define the substrate's rough surface. FIG. 2B provides a photograph of this result. As seen in FIG. 2B the metallic glass appears much more smooth than the original graphite part that was coated in the metallic glass. Accordingly, in many embodiments, a sufficient quantity of liquid phase metallic glass is applied such that the surface of the developed coating layer is smoother than that of the object that was coated with the coating layer.

Techniques for applying liquid phase metallic glass are now discussed below.

Fabricating Metallic Glass Layers Using Dipping Techniques

Figure 3:
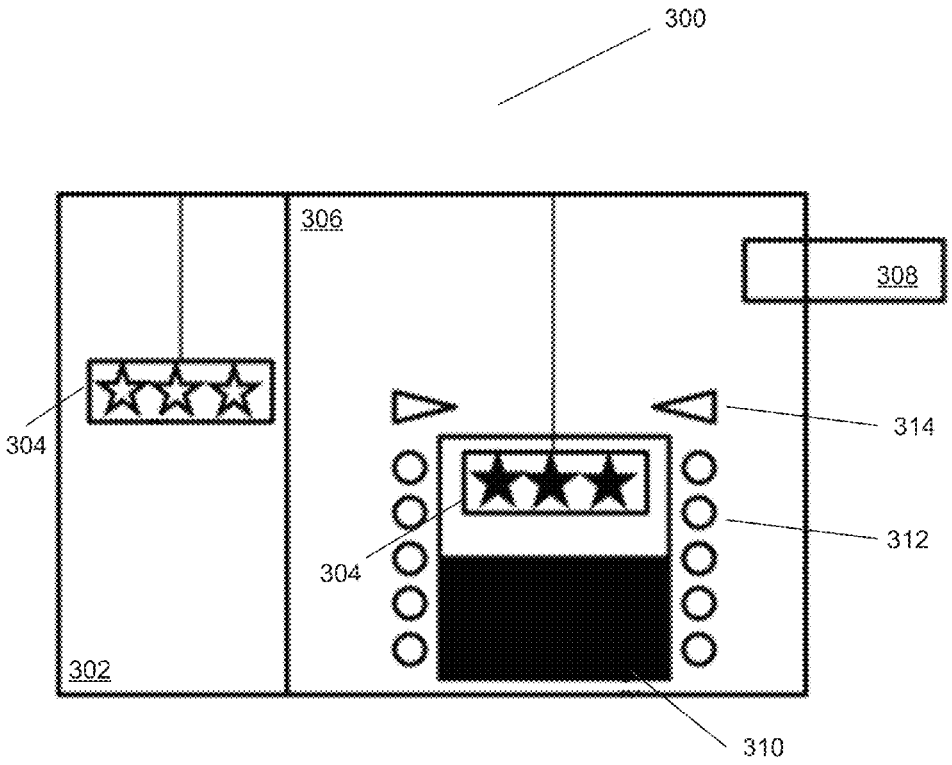
FIG. 3 illustrates dipping an object in a bath of liquid phase metallic glass to develop a layer of metallic glass on the object in accordance with embodiments of the invention

Liquid phase metallic glass can be applied to objects in many ways in accordance with embodiments of the invention. For example, an object can be dipped into a bath of liquid phase metallic glass in accordance with embodiments of the invention. A system for dipping an object in a bath of liquid phase metallic glass in an inert environment to form a layer of metallic glass in accordance with embodiments of the invention is illustrated in FIG. 3. In particular, the system 300 includes an airlock 302 that initially houses the object(s) to be coated 304. When the object 304 is ready to be coated, it is transferred to the chamber for depositing the metallic glass layer 306. The chamber 306 is substantially an inert environment. A purging line 308 is used to substantially fill the chamber 306 with an inert substance such as argon, helium, neon, and/or nitrogen, and thereby create and preserve the substantially inert environment. The inert environment can prevent the contamination of the metallic glass layer. The chamber 306 further includes a bath of liquid phase metallic glass 310, heating elements 312 to heat the bath of liquid phase metallic glass, and a source for emitting cooling gas 314 to cool an object coated in liquid phase metallic gas. The object 304 is shown having been dipped in the bath of liquid phase metallic glass 310, and ready for cooling by the source for emitting cooling gases 314. Of course, it is not necessary that the entire object be dipped in the bath of liquid phase metallic glass; in many embodiments, at least a portion of the object is dipped in the liquid phase metallic glass.

As can be inferred, dipping the object 304 (or at least a portion of it) in the bath of liquid phase metallic glass 310 is sufficient to apply a relatively substantial volume of liquid phase metallic glass to the object, e.g. such that a smooth coating layer can develop.

Figure 4:
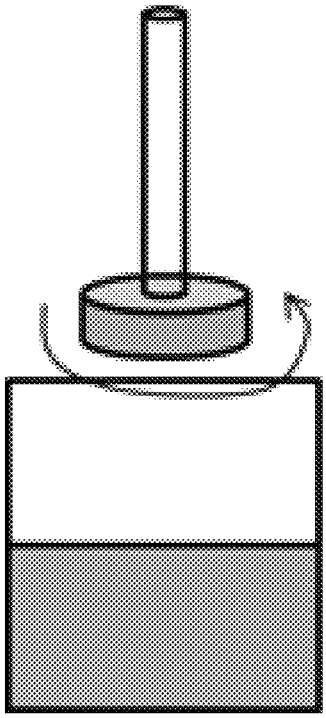
FIG. 4 illustrates spinning an object having a coating layer of liquid phase metallic glass to facilitate the wetting of the object and to eliminate excess liquid in accordance with embodiments of the invention.

As stated previously, the layer of liquid phase metallic glass can be spun to facilitate the cooling and/or to eliminate excess material. FIG. 4 demonstrates spinning an object that has been dipped in a bath of liquid phase metallic glass to eliminate excess material and/or to facilitate cooling.

It should of course be understood that any suitable metallic glass can be used, and that any suitable technique for cooling can be used in accordance with embodiments of the invention. For example, it is not necessary to use a source of cooing gases to cool the layer of metallic glass. The layer of metallic glass can be cooled simply by thermal conduction for instance.

Generally, these dipping techniques can be substantially advantageous in many respects; for example, they can provide for an efficient and economical way of developing a smooth metallic glass coating. Pouring techniques can also be used to develop layers of metallic glass, and this is now discussed below.

Fabricating Metallic Glass Layers Using Pouring Techniques

Figure 5:
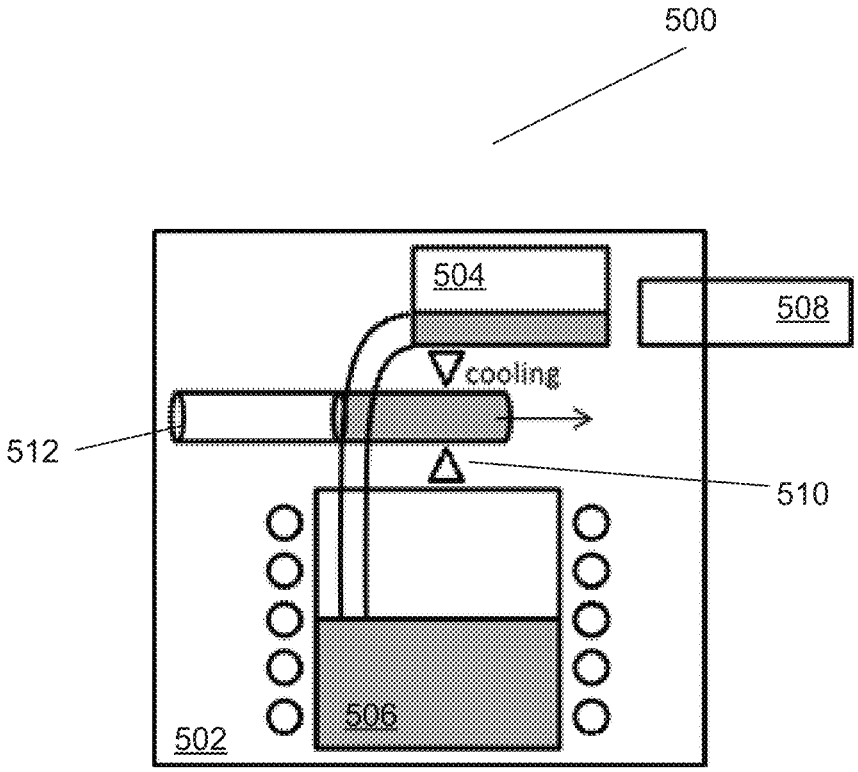
FIG. 5 illustrates pouring liquid phase metallic glass over an object to develop a layer of metallic glass on the object in accordance with embodiments of the invention.

Liquid phase metallic glass can also be poured over an object to develop a layer of metallic glass in accordance with embodiments of the invention. A system for pouring liquid phase metallic glass over an object develop a layer of metallic glass is illustrated in FIG. 5. In particular, the system 500 includes a chamber for depositing the metallic glass alloy 502, a source of liquid phase metallic glass 504, a vat for receiving excess poured liquid phase metallic glass alloy 506, a purging line 508 to maintain a substantially inert environment, and a source for cooling the layer of liquid phase metallic glass 510. Accordingly, a layer of metallic glass can be formed in accordance with embodiments of the invention by pouring the liquid phase metallic glass over an object 512, and cooling the layer of liquid phase metallic glass sufficiently quickly to form a solid phase layer of metallic glass. Again, it is not necessary that liquid phase metallic glass be poured over the entire object; in many embodiments, liquid phase metallic glass is poured over at least a portion of the object. As before, any suitable metallic glass can be used, and any suitable cooling techniques can be used, in accordance with embodiments of the invention. For example, it is not necessary to use a source of cooling gases to cool the layer of metallic glass. Such pouring techniques can also provide for an efficient and economical way to develop metallic glass layers. The above-described dipping and pouring techniques can be used in a myriad of applications whereby metallic glass coating layers are desired; some of these applications are now discussed below.

Applications for Metallic Glass Coatings

The above described techniques can be used to effectively and efficiently implement metallic glass coatings, which can possess favorable materials properties. For example, metallic glasses can be developed to possess corrosion resistance, wear resistance, and sufficient resistance to brittle failure, and otherwise favorable structural properties. Additionally, as mentioned above, techniques in accordance with embodiments of the instant invention can implement metallic glass coating layers that have a smooth surface, which can be aesthetically appealing and/or utilitarian. Thus, in many embodiments of the invention, objects are coated with metallic glass layers to enhance the functionality of the object. For example, in many embodiments, electronic casings are coated with metallic glass layers using any of the above described techniques.

Figure 6:
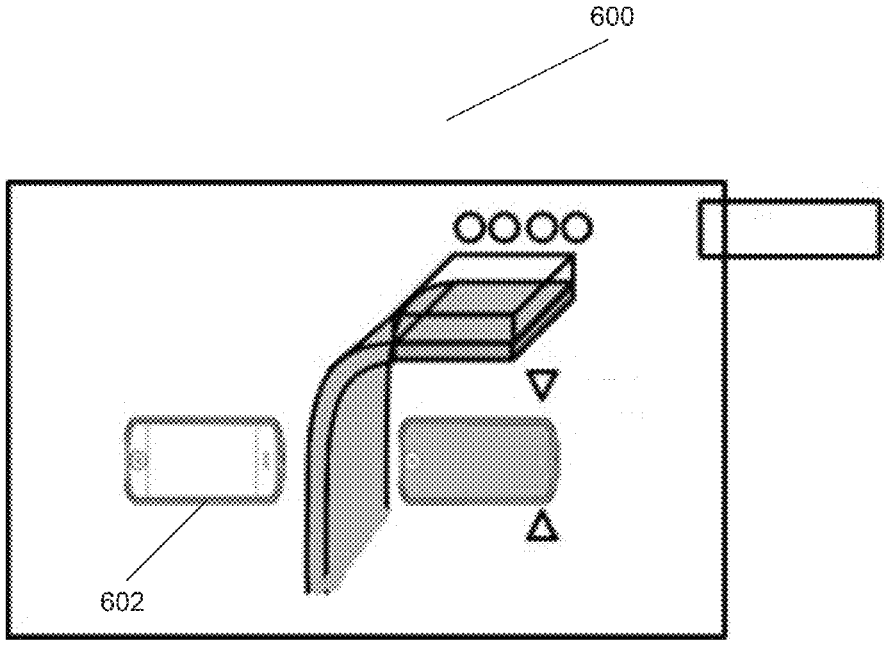
FIG. 6 illustrates coating a cell phone casing with a layer of metallic glass in accordance with embodiments of the invention.

A system for developing a metallic glass coating for a phone casing in accordance with embodiments of the invention is illustrated in FIG. 6. In particular the system 600, and its operation, is similar to that seen in, and described with respect to, FIG. 5, except that a phone case 602 is the object that is coated in a metallic glass layer. In this way, the coating can conform to the shape of the casing, and accordingly, it can be as if the casing had been fabricated entirely from the metallic glass. However, the overall cost of production of the casing coated in metallic glass may be cheaper than if the casing had been entirely fabricated from metallic glass. Additionally, if the thickness of the metallic glass coating layer is thinner than the plastic zone size of the metallic glass, the coating layer can be resistant to cracking. Further, if the base material of the coated object is relatively soft (e.g. if it is made from aluminum), the softness can provide for an enhanced toughness for the coated object as a whole. In this way, the coated object can have better structural properties as compared to if it were made from either the metallic glass or the soft base metal individually. Generally, the metallic glass coating can provide improved structural characteristics and an improved cosmetic finish. If the metallic glass coating process is applied sufficiently rapidly, it can be used to coat cases that are fabricated from alloys that have a lower melting temperature than the used metallic glass (e.g. aluminum is known to have a relatively low melting temperature.) In particular, the coated layer must be cooled prior to any diffusion of thermal energy through the underlying object that can melt it.

Of course it should be understood that although the coating of a phone casing has been described above, any suitable object can be coated using the techniques described herein in accordance with embodiments of the invention. For example, metallic glass coating layers can be deposited on any of the following objects in accordance with embodiments of the invention: laptop case, electronic case, a mirror, sheet metal, metal foams, graphite parts, parts made from refractory metals, aluminum parts, pyrolyzed polymer parts, titanium parts, steel parts, knives, gears, golf clubs, baseball bats, watches, jewelry, miscellaneous metal tools, biomedical implants, etc. Generally, any suitable objects can take advantage of the above-described techniques for developing metallic glass layers. Note that biomedical are especially well-suited for the techniques described herein as they can take advantage of the hardness and corrosion resistance that metallic glasses can offer, as well as their resistance to corrosion. Resistance to corrosion is particularly important in biomedical applications because of the potential for corrosion fatigue, which can result from corrosive biological environments. Accordingly, biomedical parts can be fabricated from metal, coated with metallic glass; in this way, the metallic glass can provide resistance to corrosion, while the underlying metal can be sufficiently resistant to corrosion fatigue. Additionally, porous foams are also well suited for the dipping techniques described above, which can enable a substantial portion of the exposed surfaces within a porous foam to be sufficiently coated.

Of course it should be understood that the application of relatively substantial volumes of liquid phase metallic glass to an object can be instituted in ways other than those corresponding to the dipping or pouring techniques described above in accordance with embodiments of the invention. For instance, spraying techniques can be implemented.

Figure 7:
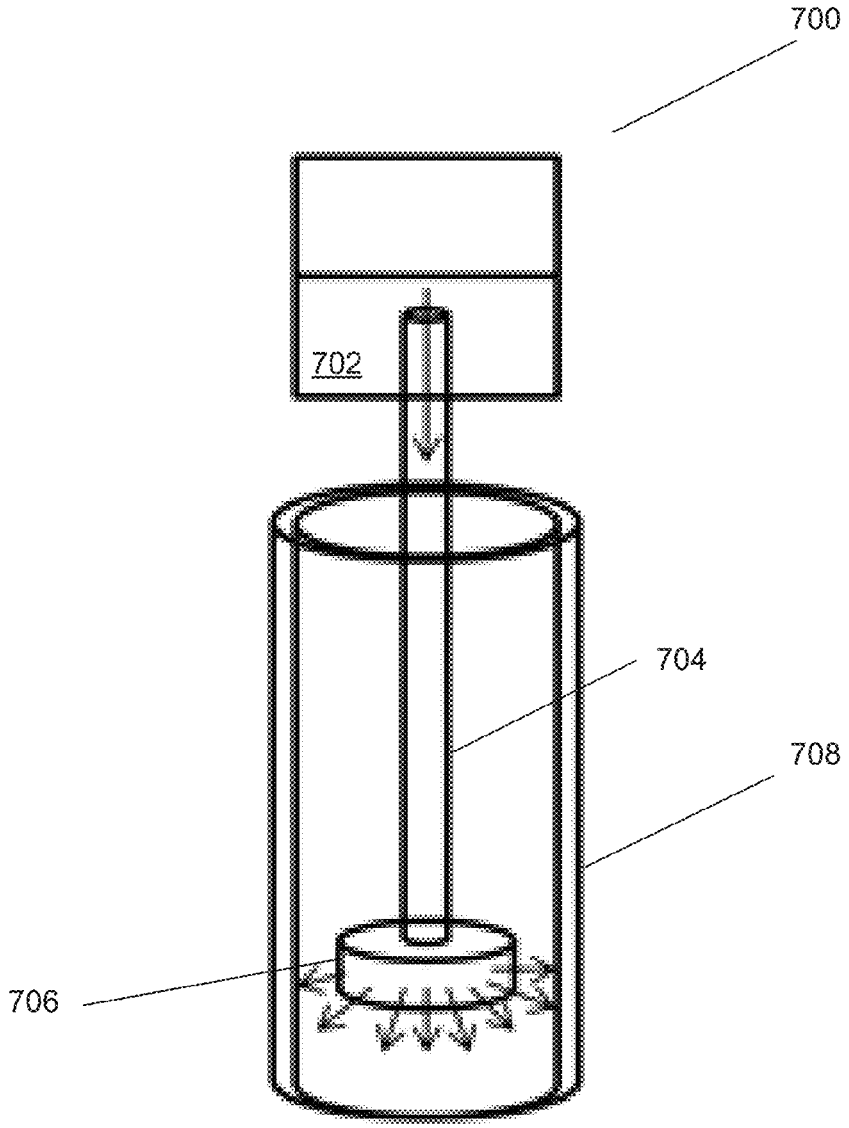
FIG. 7 illustrates spraying the inside of a piping with a layer of liquid phase metallic glass in accordance with embodiments of the invention.

A system for coating the inside of a pipe with a metallic glass layer using a spraying technique in accordance with embodiments of the invention is illustrated in FIG. 7. In particular the system 700 includes a vessel 702 for housing a liquid phase metallic glass, a tubing 704 for transporting the liquid phase metallic glass, and a spray mechanism 706 for spraying liquid phase metallic glass to the inside of a piping 708. The spray mechanism 706 applies relatively substantial volumes of liquid phase metallic glass such that a smooth coating layer can develop. Any suitable techniques for cooling the applied liquid phase metallic glass so that it forms a solid phase metallic glass can be implemented. For instance, cooling through thermal conduction can be relied on to develop a solid phase metallic glass coating layer. In some instances, cooling gas is passed through the piping. As mentioned above, coating the inside of a piping with a metallic glass layer can be beneficial in a number of respects. For example, metallic glass coatings have advantageous structural characteristics as well as corrosion resistance. Moreover, the smooth coating layer can promote laminar flow while the pipe is in operation.

It should of course be understood that although several techniques have been discussed above with respect to developing metallic glass coating layers, by applying relatively substantial volumes of liquid phase metallic glass, any number of techniques can be used to do so in accordance with embodiments of the invention. In essence, the above-descriptions are meant to be illustrative and not comprehensive. Additionally, although much of the above-discussion has been focused on developing metallic glass coating layers, free-standing metallic glass layers can also be developed in accordance with embodiments of the invention and this is now discussed.

Fabricating Free-Standing Metallic Glass Layers

Figure 8A:
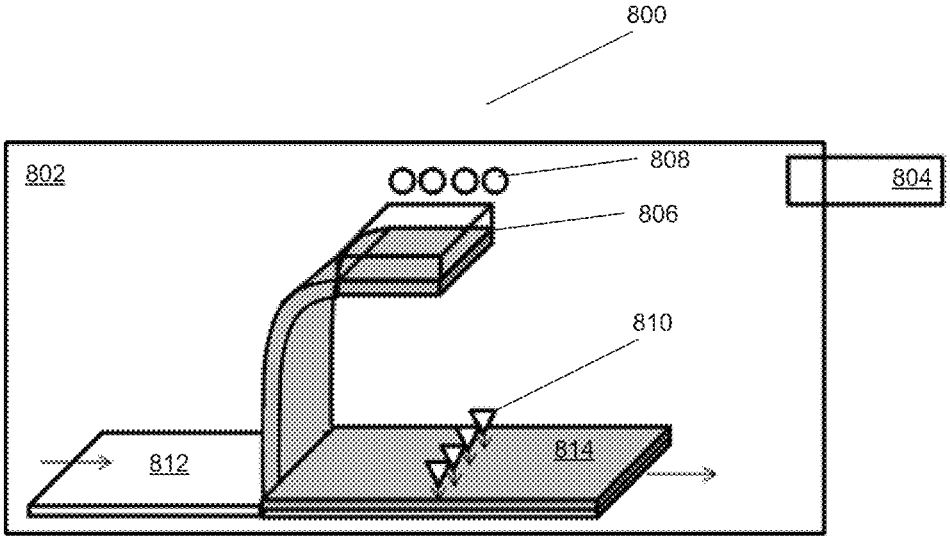
FIGS. 8A and 8B illustrate fabricating a layer of metallic glass by pouring liquid phase metallic glass over a substrate, cooling the liquid phase metallic glass, and separating the solidified metallic glass from the substrate.
Figure 8B:
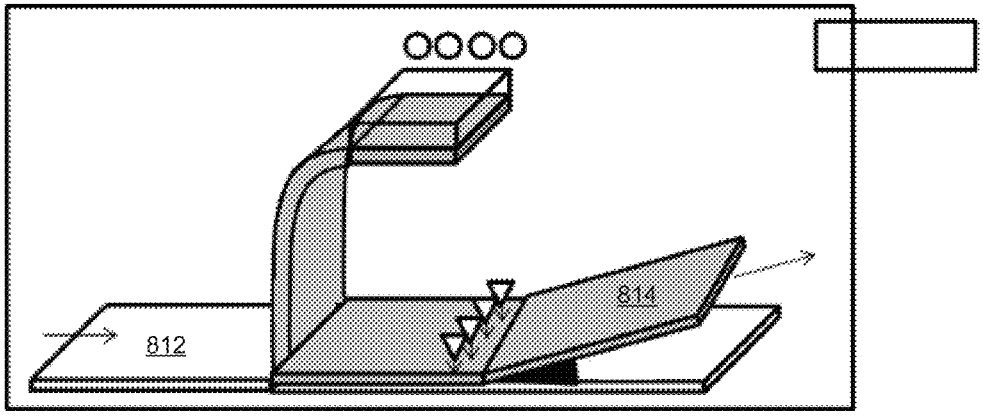

In many embodiments, free standing sheets of metallic glass layers are fabricated by depositing relatively substantial volumes of liquid phase metallic glass onto a substrate, e.g. such that a smooth coating layer can develop, allowing the liquid phase metallic glass to cool and thereby form a solid phase layer of metallic glass, and separating the solid phase metallic glass from the substrate layer. A system for fabricating free-standing sheets of metallic glass is illustrated in FIGS. 8A and 8B. In particular, the system 800 includes a chamber that houses a substantially inert environment, a purging line 804 used to substantially fill the chamber 802 with an inert substance such as argon, helium, and/or neon, and thereby create and preserve the substantially inert environment, a vessel 806 containing liquid phase metallic glass, heating elements 808 to maintain the liquid phase metallic glass, cooling elements to cool poured liquid phase metallic glass, and a substrate 812. In essence, liquid phase metallic glass from the vessel is poured onto the substrate 812, and is then allowed to cool so as to form a layer of solid phase metallic glass 814. In the illustrated embodiment, it is shown that the substrate is disposed on a conveyer belt that transports the poured liquid phase metallic glass to the cooling elements. Thereafter, as shown in FIG. 8B, the solid phase metallic glass layer 814 is removed from the substrate 812. The metallic glass layer can be removed using any suitable techniques, e.g. cutting. Thus, a free standing layer of metallic glass can be obtained. Of course, as before, any metallic glass can be used, and any cooling techniques can be used.

Figure 9:
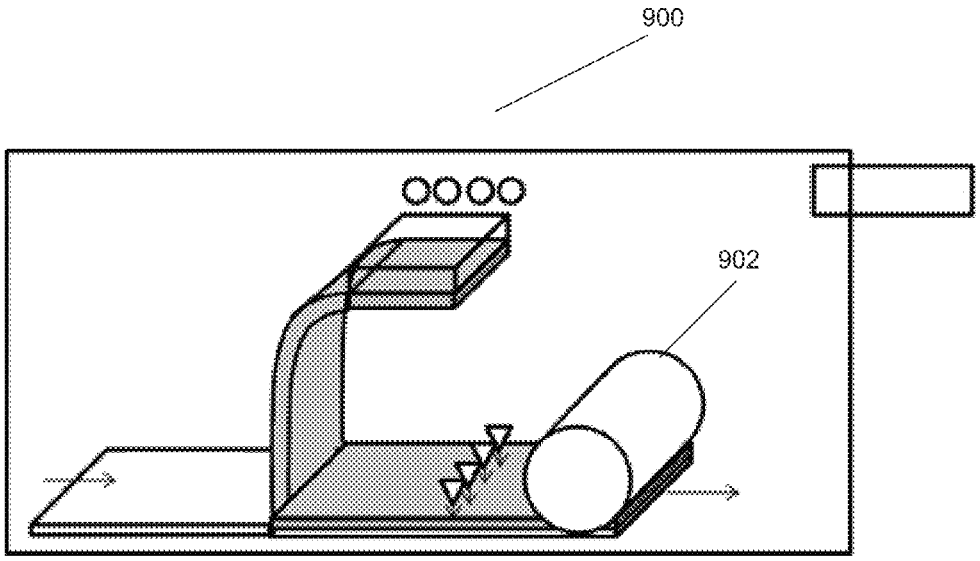
FIG. 9 illustrates using a rolling wheel to help form a liquid phase layer of metallic glass that has been poured on a substrate in accordance with embodiments of the invention.

In many embodiments of the invention, forming techniques are introduced into processes for fabricating metallic glass layers. For example, rolling wheels can be used. A rolling wheel used to form a free standing sheet in accordance with embodiments of the invention is illustrated in FIG. 9. The system 900 depicted in FIG. 9 is similar to that seen in FIGS. 8A and 8B except that it further includes a rolling wheel 902. The rolling wheel can be used to further form the metallic glass layer into a desired shape prior to its solidification. Of course it should be understood that any forming tools can be used in accordance with embodiments of the invention, not just rolling wheels. Additionally, it should be understood that such forming techniques can be used in conjunction with any of the above-described techniques in accordance with embodiments of the invention, not just those with respect to forming free standing layers of metallic glass. More generally, the above description is meant to be illustrative and not meant to be a comprehensive definition of the scope of invention. In general, as can be inferred from the above discussion, the above-mentioned concepts can be implemented in a variety of arrangements in accordance with embodiments of the invention. Accordingly, although the present invention has been described in certain specific aspects, many additional modifications and variations would be apparent to those skilled in the art. It is therefore to be understood that the present invention may be practiced otherwise than specifically described. Thus, embodiments of the present invention should be considered in all respects as illustrative and not restrictive.

What claimed is:

1. A method of fabricating a layer of metallic glass comprising:

applying a coating layer of liquid phase metallic glass to an object, wherein applying the coating layer comprises one of:

immersing at least a portion of the object in a bath of the liquid phase metallic glass; and pouring the liquid phase metallic glass over at least a portion of the object;

wherein the liquid phase metallic glass has a critical cooling rate less than 1000 K/s; and cooling the coating layer of liquid phase metallic glass to form a layer of solid phase metallic glass.

2. The method of claim 1, wherein the thickness of the coating layer is greater than 50 micrometers.

3. The method of claim 1, wherein the thickness of the coating layer is greater than 1 mm.

4. The method of claim 1, wherein the thickness of the coating layer is thinner than the plastic zone size of the metallic glass.

5. The method of claim 1, wherein the object comprises one of aluminum, titanium, steel, cobalt, graphite, quartz, silicon carbide, and mixtures thereof.

6. The method of claim 1, wherein the metallic glass is a composition that has a glass forming ability such that it can be readily cast in to parts having a thickness greater than approximately 1 mm.

7. The method of claim 1, wherein the metallic glass is a composition that has a glass forming ability such that it can be readily cast in to parts having a thickness greater than approximately 3 mm.

8. The method of claim 1, wherein the metallic glass is one of: $Cu_{40}Zr_{40}Al_7Be_{10}Nb_3$, $Cu_{45}Zr_{45}Al_5Y_2Nb_3$, $Cu_{42.5}Zr_{42.5}$Al7Be5Nb3, $Cu_{41.5}Zr_{41.5}Al_7Be_7Nb_3$, $Cu_{41.5}Zr_{41.5}Al_7Be_7Cr_3$, $Cu_{44}Zr_{44}Al_5Ni_3Be_4$, $Cu_{46.5}Zr_{46.5}Al_7$, $Cu_{43}Zr_{43}Al_7Ag_7$, $Cu_{41.5}Zr_{41.5}Al_7Be_{10}$, $Cu_{44}Zr_{44}Al_7Be_5$, $Cu_{43}Zr_{43}Al_7Be_7$, $Cu_{44}Zr_{44}Al_7Ni_5$, $Cu_{40}Zr_{40}Al_{10}Be_{10}$, $Cu_{41}Zr_{40}Al_7Be_7Co_5$, $Cu_{42}Zr_{41}Al_7Be_7Co_3$, $Cu_{47.5}Zr_{48}Al_4Co_{0.5}$, $Cu_{47}Zr_{46}Al_5Y_2$, $Cu_{50}Zr_{50}$, $Ti_{33.18}Zr_{30.51}Ni_{5.33}Be_{22.88}Cu_{8.1}$, $Ti_{40}Zr_{25}Be_{30}Cr_5$, $Ti_{40}Zr_{25}Ni_8Cu_9Be_{18}$, $Ti_{45}Zr_{16}Ni_9Cu_{10}Be_{20}$, $Zr_{41.2}Ti_{13.8}CU_{12.5}Ni_{10}Be_{22.5}$, $Zr_{52.5}Ti_5CU_{17.9}Ni_{14.6}Al_{10}$, $Zr_{58.5}Nb_{2.5}Cu_{15.6}Ni_{12.8}Al_{10.3}$, $Zr_{55}Cu_{30}Al_{10}Ni_5$, $Zr_{65}Cu_{17.5}Al_{7.5}Ni_{10}$, ZrAlCo, $Zr_{36.6}Ti_{31.4}Nb_7Cu_{5.9}Be_{19.1}$, $Zr_{35}Ti_{30}Cu_{8.25}Be_{26.75}$, and mixtures thereof.

9. The method of claim 1, wherein cooling the coating layer comprises subjecting the liquid phase metallic glass to cooling gases.

10. The method of claim 1, wherein cooling the coating layer comprises allowing the coating layer to cool via thermal conduction.

11. The method of claim 1, further comprising spinning the coating layer of liquid phase metallic glass to eliminate excess liquid phase metallic glass.

12. The method of claim 1, wherein the object has a lower melting temperature than the metallic glass, and where the cooling is done with such rapidity that thermal energy from the coating layer does not have time to diffuse from the coating layer to the object to thereby melt it.

13. The method of claim 1, wherein the object is the interior of a pipe.

14. The method of claim 1, wherein the application of a coating of liquid phase metallic glass to an object and the cooling of the coating layer of liquid phase metallic glass occur in an inert environment to discourage contamination of the layer of metallic glass.

15. The method of claim 14, wherein the inert environment is effectuated by substantially immersing the object in one of argon, helium, neon, nitrogen, and mixtures thereof.

16. The method of claim 15, wherein the object is one of: a laptop case, an electronic case, a mirror, sheet metal, a metal foam, a graphite part, a part made from refractory metals, an aluminum part, a pyrolyzed polymer part, a titanium part, a steel part, a knife, a gear, a golf club, a baseball bat, a watch, jewelry, a metal tool, and a biomedical implant.

17. The method of claim 1, wherein a forming tool is used to form the coated layer of liquid phase metallic glass.

18. The method of claim 17, where the forming tool is a rolling wheel.

19. The method of claim 1, further comprising separating the layer of solid phase metallic glass from the object.

20. The method of claim 1, wherein the solid phase metallic glass has a surface that is smoother than a surface of the object to which the coating layer of liquid phase metallic glass is applied.

* * * * *